US006561433B2

(12) United States Patent
Sudo et al.

(10) Patent No.: US 6,561,433 B2
(45) Date of Patent: May 13, 2003

(54) THERMAL EXPANSION VALVE

(75) Inventors: Makoto Sudo, Tokyo (JP); Daisuke Watari, Tokyo (JP); Kazuhiko Watanabe, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/051,181

(22) Filed: Jan. 22, 2002

(65) Prior Publication Data

US 2002/0100812 A1 Aug. 1, 2002

(30) Foreign Application Priority Data

Jan. 31, 2001 (JP) ..... 2001-022643

(51) Int. Cl.[7] ..... F25B 41/04; G05D 27/00
(52) U.S. Cl. ..... 236/92 B; 62/222
(58) Field of Search ..... 236/92 B; 62/222

(56) References Cited

U.S. PATENT DOCUMENTS 4,005,055 A * 1/1977 Miron et al. ..... 156/331.1
4,661,190 A * 4/1987 Gelinas et al. ..... 156/273.3
4,778,253 A * 10/1988 Siga et al. ..... 156/89.15
5,303,864 A * 4/1994 Hirota ..... 236/92 B
5,628,569 A * 5/1997 Hayakawa et al. ..... 384/100
5,924,629 A * 7/1999 Kobayashi et al. ..... 219/137 R
5,996,899 A * 12/1999 Watanabe et al. ..... 236/92 B
6,062,484 A * 5/2000 Eybergen ..... 236/92 B
6,427,243 B2 * 8/2002 Kobayashi et al. ..... 236/92 B

FOREIGN PATENT DOCUMENTS

JP 402028587 A * 1/1990 ..... G04B/39/02
JP 03045668 A * 2/1991 ..... C09J/5/00
JP 03052978 A * 3/1991 ..... C09J/5/00
JP 05320584 A * 12/1993

* cited by examiner

*Primary Examiner*—William C. Doerrler
*Assistant Examiner*—Mohammad M. Ali
(74) *Attorney, Agent, or Firm*—Rader, Fishman & Grauer PLLC

(57) ABSTRACT

A hole 15 is formed to the center portion of an outer wall 14 of a housing defining an airtight chamber, and temperature sensitive gas is filled in the interior of the housing. The hole 15 is sealed by a plug 16 and is fixed by a weld portion 17. An anaerobic UV cure adhesive 34 is filled in the recess 18 formed around the projection weld portion 17, and cured by UV radiation. The surface of the anaerobic UV cure adhesive 34 cures rapidly, and the inner area of the adhesive where UV cannot be radiated is cured infallibly. The thermal expansion valve having such structure can be arranged in an engine room, where corrosion due to water adhering to the weld can be prevented effectively, and as a result prevents gas leak from the weld portion.

4 Claims, 4 Drawing Sheets

THERMAL EXPANSION VALVE

FIELD OF THE INVENTION

The present invention relates to a thermal expansion valve equipped in a refrigeration system of an air conditioner for a vehicle and the like.

DESCRIPTION OF THE RELATED ART

FIG. 3 shows a conventional thermal expansion valve equipped in a refrigeration cycle of an air conditioner for a vehicle and the like. The conventional thermal expansion valve 100 comprises a valve body 1 including a high-pressure refrigerant passage 2 through which liquid-phase refrigerant to be decompressed travels, a low-pressure refrigerant passage 3 through which gas-phase refrigerant travels, and a valve hole 4 formed in the middle of the high-pressure refrigerant passage 2; a valve means 5 that is driven to move toward and away from the valve hole 4 and thereby changing the opening of the valve hole; a pressure operation housing 10 equipped to the valve body 1 so as to sense the temperature of the gas-phase refrigerant, including a diaphragm 11 that drives the valve means 5 via an operating rod 6 so as to control the movement of the valve means, an airtight chamber 12 divided by the diaphragm and filled with a temperature sensitive gas, and a pressure equalizing chamber 13 being communicated with the low-pressure refrigerant passage 3; and a plug 16 for sealing a hole 15 formed to the outer wall 14 of the pressure operation housing after the temperature sensitive gas is filled to the airtight chamber 12, maintaining the gas-filled state.

In the drawing, reference 30 shows a compressor connected via a piping to the exit of the low-pressure refrigerant passage 3, reference 31 is a condenser connected via a piping to the compressor 30, reference 32 is a receiver tank connected via a piping to the condenser 31 and the entrance of the high-pressure refrigerant passage 2, and reference 33 is an evaporator connected via a piping to the exit of the high-pressure refrigerant passage 2 and the entrance of the low-pressure refrigerant passage 3.

A conventional method to seal the hole 15 on the outer wall with the plug 16 is disclosed in Japanese Patent Laid-Open Publication No. 6-185833 (185833/94). This prior-art welding method involves two welding steps, wherein the first welding step is a projection welding performed as a temporal welding with only temporal intensity, and the second welding step is performed by the solder-welding portion 19 that provides a lasting seal.

That is, as shown in FIG. 4 showing the partial enlarged view of the plug 16 and the hole 15 on the housing outer wall 14, the edge contact portion 19*a* between the spherical surface of the plug 16 and the circumferential portion of the housing outer wall 14 is projection-welded, thereby sealing the flange portion of the plug 16 by a solder weld 19.

In another example of a conventional thermal expansion valve, the means for sealing a hole 15 on the outer wall of the housing with a plug 16 is disclosed in Japanese Patent Laid-Open Publication No. 8-226567 (226567/96). The structure of this thermal expansion valve is shown in FIG. 5. FIG. 5 shows a vertical cross-sectional view of the prior-art thermal expansion valve 100. In the drawing, the thermal expansion valve 100 is equipped to a refrigeration cycle of an air conditioner for a vehicle and the like, wherein the valve body 1 of the thermal expansion valve 100 includes a high-pressure refrigerant passage 2 through which liquid-phase refrigerant to be decompressed travels, a low-pressure refrigerant passage 3 through which gas-phase refrigerant travels, and a valve hole 4 formed in the middle of the high-pressure refrigerant passage 2 comprising a small-diameter throttle hole. The liquid-phase refrigerant flowing from the receiver tank 32 to the high-pressure refrigerant passage 2 passes through the valve hole 4 having a small airflow area, where it experiences adiabatic expansion before flowing into the passage 2' for decompressed refrigerant.

The opening of the valve hole 4 where the refrigerant enters is formed as a valve seat, and at this valve seat is positioned a ball-shaped valve means 5 that can move toward and away from the valve seat, thereby changing the opening of the valve hole 4. The valve means 5 is supported by a ball receiver 7, and is biased toward closing the valve (toward being pressed against the valve seat of the valve hole 4) by a compression coil spring 9 mounted between the ball receiver 7 and an adjusting nut 8.

Reference number 10 shows a pressure operation housing that is arranged at the upper end of the valve body 1 for sensing the temperature of the gas-phase refrigerant, comprising a diaphragm 11 that drives the valve means 5 through the operating rod 6, an airtight chamber 12 divided by the diaphragm and filled with temperature sensitive gas, and a pressure equalizing chamber 13 that communicates with the low-pressure refrigerant passage 3.

A hole 15 is formed to the outer wall 14 of the housing 10, and through this hole the temperature sensitive gas is filled into the airtight chamber 12, and thereafter, the hole 15 on the outer wall is sealed using a metal plug 16 so as to maintain the gas-filled state.

Accordingly, the airtight chamber 12 senses the temperature of the gas-phase refrigerant traveling through the low-pressure refrigerant passage 3, and the pressure within the airtight chamber 12 changes following the fluctuation of the temperature of the gas-phase refrigerant. On the other hand, the pressure equalizing chamber 13 positioned on the lower stream side of the diaphragm 11 is communicated, as mentioned above, with the low-pressure refrigerant passage 3, so that the pressure of the chamber 13 equals the pressure of the gas-phase refrigerant traveling through the low-pressure refrigerant passage 3. This structure enables the diaphragm 11 to be displaced according to the difference between the pressure within the airtight chamber 12 and the pressure within the pressure equalizing chamber 13, and this movement is transmitted via the operating rod 6 to the valve means 5 that controls the opening of the valve hole 4.

The plug 16 comprises a projection 16*a* that is inserted to the hole 15 of the housing outer wall 14 as shown in FIG. 6, and a cone-shaped portion 16*b* that contacts the circumference of the hole 15 of the housing outer wall 14 (the circumference forming a cross section that is sloped diagonally downward in a wide separated V-shape with a taper angle of 120 degrees toward the center of the hole 15) with the tapered surface thereof having a taper angle of 90 to 120 degrees. The tapered contact surfaces of the cone-shaped portion 16*b* and the circumference of the hole formed to the outer wall 14 is projection welded with a length ranging from 0.2 mm to 1.5 mm, thereby forming a weld portion 17, so that the hole 15 on the outer wall is sealed only by a projection weld maintaining the state where the chamber is completely filled with gas.

According to the prior art thermal expansion valve, if water (caused for example by dew condensation) adheres to the periphery of the plug, the weld portion may be corroded, and when corrosion occurs, air may leak through the welded portion. In other words, for example in the thermal expansion valve shown in FIG. 5, the periphery of the hole on the housing outer wall 14 and the plug 16 come into contact at their tapered surfaces and are attached together by projection weld as shown in FIG. 6, but since a recessed portion 18 exists around the projection weld portion 17, if water gathers around the recess 18, the weld is corroded and the airtight state can be damaged at the weld portion.

In order to solve this problem, in a conventional thermal expansion valve, a corrosion inhibitor (such as an adhesive) is injected to the recessed portion, as shown in FIG. 7.

FIG. 7 is an enlarged vertical cross-sectional view showing the structure of the plug 16 and the housing outer wall 14 that constitutes the main area of the conventional thermal expansion valve of FIG. 5. In the drawing, a part of the plug body and the housing outer wall are omitted, and it shows how the corrosion inhibitor is provided to fill the recessed portion 18. In the drawing, reference 21 is the corrosion inhibitor filled in the recessed portion 18, and the corrosion inhibitor 21 is arranged to cover the circumference of the welding portion 17 between the plug 16 and the housing outer wall 14 so as to prevent water from gathering thereto.

However, if a general adhesive is used as the corrosion inhibitor, it requires time to harden, and the manufacturing cost is increased. It is possible to increase the hardening speed by radiating ultraviolet or visible light to the adhesive, but according to such method, the radiated surface hardens completely but the inner area of the adhesive where ultraviolet or visible light cannot be radiated can be left unhardened. If the hardened surface is somehow damaged and the inner area of the adhesive is not hardened, the corrosion damages the airtight seal of the welded portion, and may cause deterioration of the function of the thermal expansion valve.

SUMMARY OF THE INVENTION

The present invention aims at solving the above problems of the prior art by providing a thermal expansion valve that has an improved stability against environment, that can be applied to use in the engine room where a high water-proof property is required, that can prevent gas leakage caused by corrosion of the welded portion, and that contributes to cutting down the manufacturing cost.

In order to achieve the above-mentioned objects, the thermal expansion valve according to the present invention comprises a valve means for changing the opening of a valve hole and thereby controlling the flow of refrigerant traveling to an evaporator in a refrigeration cycle; a housing including an airtight chamber filled with a temperature sensitive gas, the pressure of which changes according to the change in the refrigerant temperature so as to drive said valve means; and a plug welded to and sealing a hole formed to said housing, thereby airtightly sealing said temperature sensitive gas in said airtight chamber; wherein the periphery of the weld portion of said plug is covered by an anaerobic UV cure adhesive.

Moreover, the thermal expansion valve according to the present invention comprises a valve means for changing the opening of a valve hole and thereby controlling the flow of refrigerant traveling to an evaporator in a refrigeration cycle; a housing including an airtight chamber filled with a temperature sensitive gas, the pressure of which changes according to the change in the refrigerant temperature so as to drive said valve means; and a plug welded to and sealing a hole formed to said housing, thereby airtightly sealing said temperature sensitive gas in said airtight chamber; wherein the tapered surface on the periphery of said hole and the tapered surface of said plug are welded together only by projection weld, and the periphery of the weld portion of said plug is covered by an anaerobic UV cure adhesive.

Furthermore, the anaerobic UV cure adhesive is filled to a recessed portion formed around said weld portion.

According to the thermal expansion valve of the present invention where a UV cure adhesive provided with an anaerobic property is used to cover the weld, the surface of the adhesive can be cured rapidly by ultraviolet radiation, and the inner area of the adhesive where it is difficult to radiate ultraviolet can also be cured infallibly since the adhesive becomes anaerobic when the surface is cured.

As explained, according to the thermal expansion valve of the present invention, not only can the adhesive be cured in a shorter period of time but also the inner area thereof can be cured infallibly, thereby improving the corrosion resistance of the thermal expansion valve and preventing damage to the airtight seal of the weld portion. Moreover, even if the surface of the adhesive is deteriorated, the inner area of the adhesive is completely cured, still enabling to prevent corrosion of the weld portion and preventing gas leakage therefrom.

DETAILED DESCRIPTION OF THE PREFERRED EMBODIMENT

The preferred embodiment of the present invention will now be explained with reference to the drawings.

Figure 1:
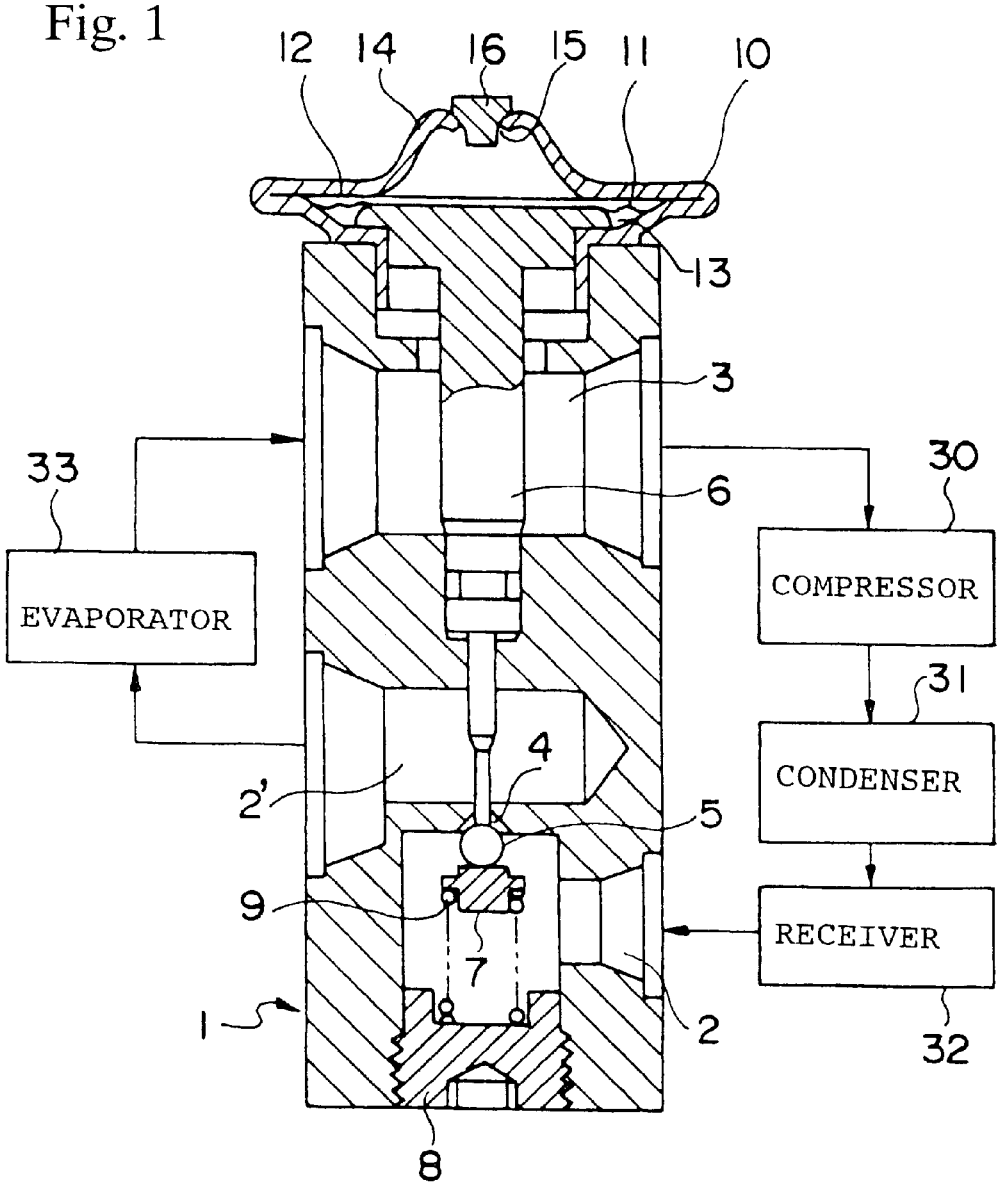
FIG. 1 is a vertical cross-sectional view showing one embodiment of the thermal expansion valve according to the present invention.
Figure 2:
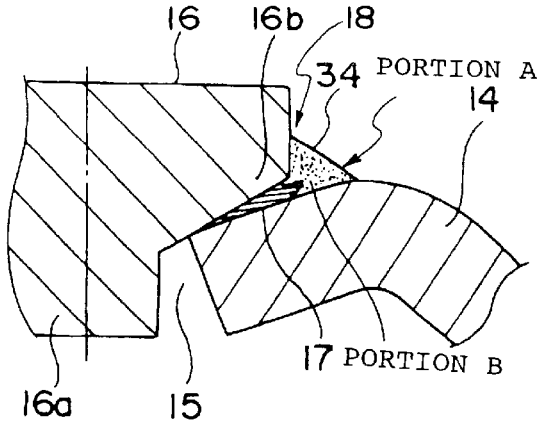
FIG. 2 is an enlarged vertical cross-sectional view of the main portion of the embodiment of FIG. 1.
Figure 5:
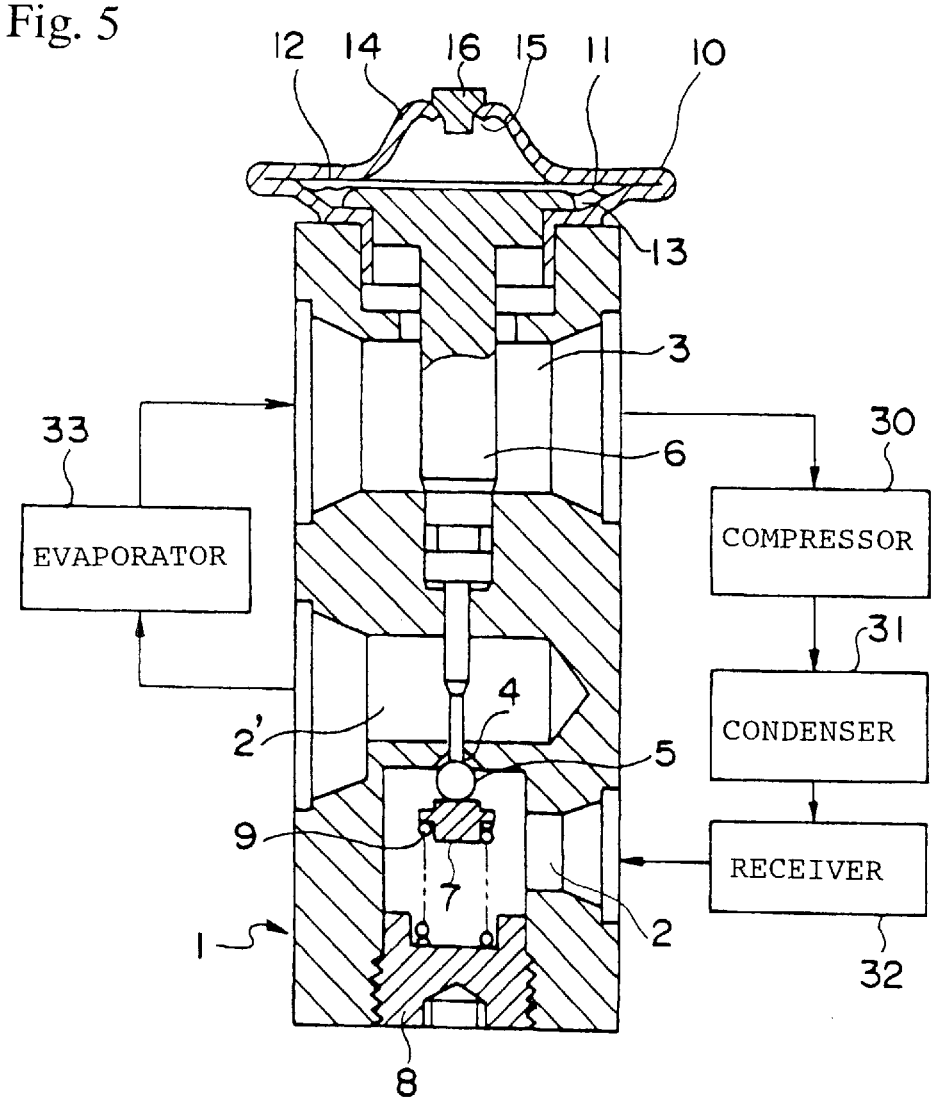
FIG. 5 is a vertical cross-sectional view showing the structure of another conventional thermal expansion valve.
Figure 6:
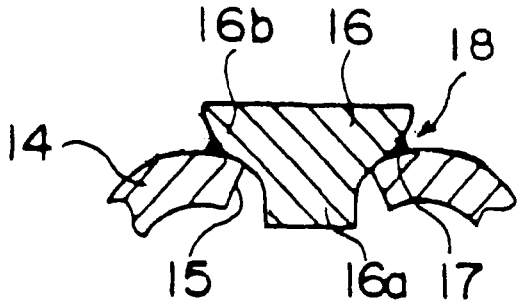
FIG. 6 is an enlarged cross-sectional view showing the main portion of the thermal expansion valve of FIG. 5.
Figure 7:
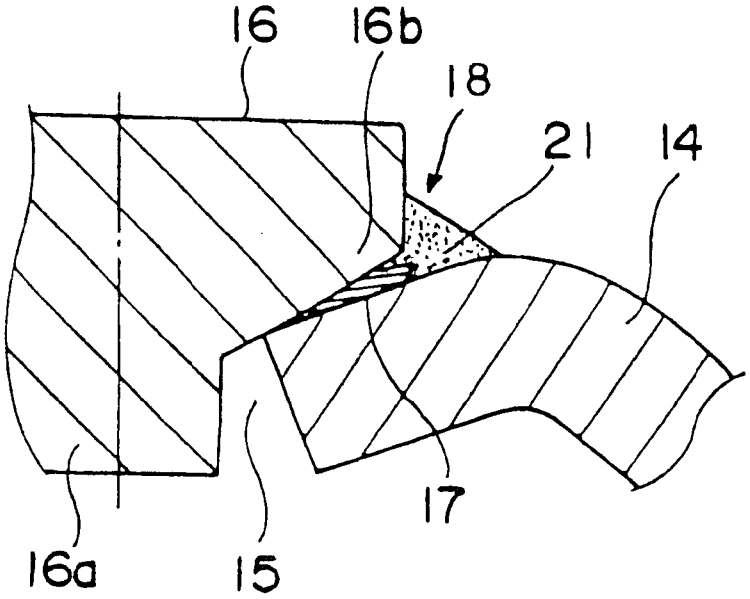
FIG. 7 is an enlarged cross-sectional view showing the state where an adhesive is injected to the conventional structure of FIG. 6.

FIG. 1 is a vertical cross-sectional view showing one preferred embodiment of the thermal expansion valve according to the present invention, and FIG. 2 is an enlarged cross-sectional view of the welded portion between the plug and the housing outer wall, showing the state where an anaerobic ultraviolet (UV) cure adhesive is applied to the conventional thermal expansion valve shown in FIG. 5. Therefore, in the present embodiment of FIG 1, the structure of the thermal expansion valve is completely the same as that of the conventional thermal expansion valve, the present valve operates in the same manner as the conventional valve, and the only thing that differs is that in the present embodiment, the adhesive shown in FIG. 7 is replaced with an anaerobic UV cure adhesive. The identical members of FIG. 1, FIG. 2, FIG. 5 and FIG. 7 are provided with the same reference numbers, and the explanations thereof are omitted. In FIG. 2, reference 34 shows the anaerobic UV cure adhesive filled in the recessed portion 18 formed around the projection weld portion 17, which cures by the radiation of ultraviolet.

That is, portion A of FIG. 2 referring to the surface of the anaerobic adhesive 34 is cured rapidly by the radiation of ultraviolet, and further, portion B referring to the inner portion of the adhesive where it is difficult to radiate ultraviolet can also be cured infallibly since portion A becomes anaerobic by the surface cure. According to such structure of the present invention, the periphery of the weld portion 17 is covered by the anaerobic UV cure adhesive 34. According to the preferred embodiment of the present invention, even if the present thermal expansion valve is arranged for example in an engine room of a vehicle, corrosion of the weld portion 17 caused by the gathering or adhering of water to the weld can be prevented effectively, providing improved corrosion-resistance to the expansion valve, and preventing damage to the airtight seal of the weld portion. Examples of the UV cure adhesive are product names 358 and 3504 manufactured by Loctite Japan Corporation.

Further, in the structure shown in FIG. 2, even if portion A (the surface) of the UV cure adhesive 34 is damaged or lost after it is cured, portion B is completely cured as well, thereby effectively preventing the occurrence of a corrosion to the weld portion 17 which was caused conventionally by uncured portions existing in the inside of the weld portion. The present invention improves the corrosion resistance of the weld portion of the thermal expansion valve, and thereby prevents gas leakage occurring in the weld portion 17.

Figure 3:
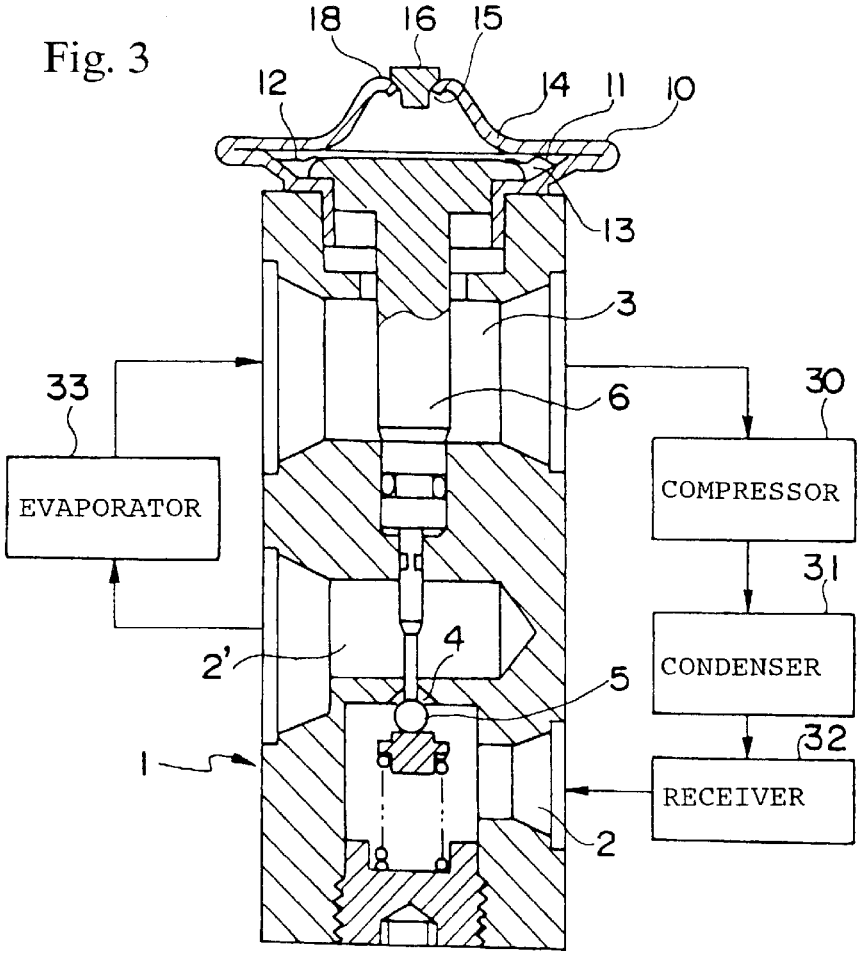
FIG. 3 is a vertical cross-sectional view showing the structure of the conventional thermal expansion valve.
Figure 4:
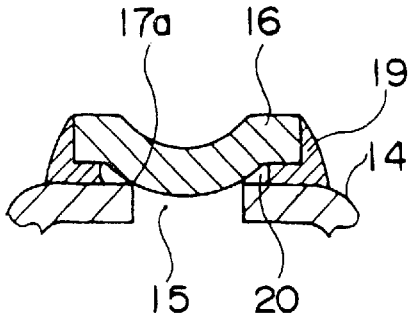
FIG. 4 is an enlarged cross-sectional view of the main portion of the thermal expansion valve of FIG. 3.

Moreover, the present invention refers to the case where the anaerobic UV cure adhesive is applied to the conventional thermal expansion valve shown in FIG. 5, but the present invention is not limited to such application, and it can be applied to other types of conventional thermal expansion valves, one example of which is shown in FIGS. 3 and 4, providing the advantageous features of the present invention by applying the anaerobic UV cure adhesive to cover the periphery of the weld portion 19.

As explained, according to the thermal expansion valve of the present invention, the periphery of the weld portion surrounding the plug is covered by an anaerobic UV cure adhesive, thereby reducing the time required to cure the adhesive, and infallibly curing the inner portion of the adhesive, so that the corrosion resistance of the weld portion is improved greatly and the gas leakage due to corrosion of the weld portion is prevented. Thereby, the present invention enables to realize a thermal expansion valve that can be manufactured at a low cost and with advantageous resistance to the environment surrounding the valve.

What is claimed is:

1. A thermal expansion valve comprising:

a valve means for changing the opening of a valve hole and thereby controlling the flow of refrigerant traveling to an evaporator in a refrigeration cycle;

a housing including an airtight chamber filled with a temperature sensitive gas, the pressure of which changes according to the change in the refrigerant temperature so as to drive said valve means; and a plug welded to and sealing a hole formed to said housing by a weld, thereby airtightly sealing said temperature sensitive gas in said airtight chamber;

wherein periphery of the weld is covered by an anaerobic UV cure adhesive having an exterior surface portion spanning between and in contact with the plug and the housing and an inner portion extending between and in contact with the exterior surface portion and the weld and extending between and in contact with the plug and the housing, the exterior surface portion cured by anaerobic UV radiation and the inner portion cured as a result of the anaerobic UV radiation cured exterior surface portion.

2. A thermal expansion valve comprising:

a valve means for changing the opening of a valve hole and thereby controlling the flow of refrigerant traveling to an evaporator in a refrigeration cycle;

a housing including an airtight chamber filled with a temperature sensitive gas, the pressure of which changes according to the change in the refrigerant temperature so as to drive said valve means; and a plug welded to and sealing a hole formed to said housing, thereby airtightly sealing said temperature sensitive gas in said airtight chamber;

wherein the tapered surface at the periphery of said hole and the tapered surface of said plug are welded together only by a projection weld, and an outer periphery of the weld is covered by an anaerobic UV cure adhesive having an exterior surface portion spanning between and in contact with the plug and the housing and an inner portion extending between and in contact with the exterior surface portion and the weld and extending between and in contact with the plug and the housing, the exterior surface portion cured by anaerobic UV radiation and the inner portion cured as a result of the anaerobic UV radiation cured exterior surface portion.

3. A thermal expansion valve according to claim 2, wherein said anaerobic UV cure adhesive is filled in a recessed portion formed around said weld portion.

4. A method for inhibiting corrosion of a weld connecting a plug and a housing of a thermal expansion valve, comprising the steps of:

covering an outer periphery of the weld within anaerobic UV cure adhesive having an exterior surface portion spanning between and in contact with the plug and the housing and an inner portion extending between and in contact with the exterior surface portion and the weld and extending between and in contact with the plug and the housing; and applying UV radiation to the exterior surface portion of the anaerobic UV cure adhesive until the exterior surface portion is cured, the cured anaerobic exterior surface portion causing the inner portion to cure thereby providing a completely cured anaerobic UV cure adhesive isolating the weld from corrosive elements exterior of the thermal expansion valve.

* * * * *